United States Patent [19]

Gelbard et al.

[11] Patent Number: 4,497,183

[45] Date of Patent: Feb. 5, 1985

[54] COMPRESSOR AUXILIARY CONDENSER ARRANGEMENT ADAPTED TO BE MOUNTED IN A REFRIGERATOR MACHINERY COMPARTMENT

[75] Inventors: Robert B. Gelbard; Bernard J. Grimm; William D. Irish, all of Louisville, Ky.

[73] Assignee: General Electric Company, Louisville, Ky.

[21] Appl. No.: 592,830

[22] Filed: Mar. 23, 1984

[51] Int. Cl.[3] ..... F25D 19/00

[52] U.S. Cl. ..... 62/295; 62/279

[58] Field of Search ..... 62/277, 279, 295

[56] References Cited

U.S. PATENT DOCUMENTS

| | | | |
|---|---|---|---|
| 1,967,035 | 7/1934 | Lipman | 203/207 |
| 2,679,144 | 5/1954 | Grimshaw et al. | 62/103 |
| 2,721,451 | 10/1955 | Schumacher | 62/103 |
| 2,776,547 | 1/1957 | King et al. | 62/116 |
| 2,801,525 | 8/1957 | Bixler | 62/4 |
| 2,876,632 | 3/1959 | King | 62/285 |
| 2,940,279 | 6/1960 | Schumacher | 62/277 |
| 3,191,897 | 6/1965 | Comerer | 248/26 |
| 3,374,945 | 3/1968 | Engleman et al. | 230/235 |
| 3,584,469 | 6/1971 | Butts | 62/295 |
| 3,893,307 | 7/1975 | Jacobs | 62/150 |
| 3,937,598 | 2/1976 | Stannow et al. | 417/363 |
| 4,156,352 | 5/1979 | Gelbard et al. | 62/295 X |

*Primary Examiner*—William E. Wayner

*Attorney, Agent, or Firm*—Frank P. Giacalone; Radford M. Reams

[57] ABSTRACT

A unitary refrigerator compressor and auxiliary condenser assembly adapted to be installed in the machinery compartment of a domestic refrigerator. The assembly includes a serpentine portion of the auxiliary condenser having an inlet and outlet end connected to the compressor, and a container supported on the serpentine portion for providing evaporation of water collected in the container. The serpentine portion of the condenser and container are in intimate heat exchange contact by virtue of adhesive bonding between the two components, and are resiliently supported on the base member so as to vibrate in unison with said compressor.

4 Claims, 4 Drawing Figures

COMPRESSOR AUXILIARY CONDENSER ARRANGEMENT ADAPTED TO BE MOUNTED IN A REFRIGERATOR MACHINERY COMPARTMENT

BACKGROUND OF THE INVENTION

The present invention relates generally to refrigerators of the type wherein the high-side portion of the refrigeration system is arranged in a machinery compartment which is isolated from the food storage compartment of the refrigerator, and more particularly to a unitary system including the compressor and auxiliary condenser arrangement which are resiliently mounted on a base member so as to vibrate in unison.

In refrigerators using a natural convection condenser system, the condenser is usually mounted on the back wall of the refrigerator. Depending on the type compressor used it may be necessary to provide an auxiliary condenser for the purpose of providing oil cooling. This added volume of tubing must either be accommodated by placing it in the same area of the condenser in which case the condenser must be made taller or the refrigerator must be maintained a further distance from the wall on which it is to be arranged. In the alternative, the auxiliary condenser may be arranged in the machinery compartment as shown in U.S. Pat. No. 2,721,451 and U.S. Pat. No. 2,679,144, both assigned to the General Electrical Company, the assignee of the present invention.

Some refrigerators include means for automatically defrosting the evaporator upon which frost forms and collects. Often such refrigerators also include means whereby moisture resulting from a defrosting operation is evaporated into the atmosphere outside the food storage compartments and thereby disposed of. One arrangement for so disposing of the defrost moisture as shown in the above referenced patents includes using the auxiliary condenser in the machinery compartment and a drain pan in heat exchange relationship with the auxiliary condenser. In this arrangement the defrost moisture is directed into the drain pan from the evaporator located in the food storage compartment and is evaporated by the heat from the auxiliary condenser.

While this is a convenient and efficient way of evaporating moisture, it does present some problems in that the operating compressor vibrates relative to its mount. Since the auxiliary condenser is connected to the compressor through relatively rigid tubing, the vibrations from the compressor are transferred to the auxiliary condenser and pan structure. This results in excessive noise and further possible damage from metal fatigue can occur.

SUMMARY OF THE INVENTION

Accordingly, the present invention has as its primary objective means for mounting the compressor and auxiliary condenser assembly on the same support structure so that they will vibrate un unison.

Another object of the invention is to provide an auxiliary condenser, condensate pan arrangement which is utilized for both evaporating defrost moisture and for cooling compressor oil, if desired.

Another objective of the invention is to increase the heat exchange relationship between the auxiliary condenser and condensate pan so as to allow a high natural convective heat dissipation and defrost condensate evaporation in a minimum of space.

Another object of the invention is to provide a lateral arrangement of the components in the rear portion of the cabinet so as to allow the front portion of the cabinet to be configured lower to the floor to thereby increase the capacity of the food storage compartment.

A household refrigerator is provided including a cabinet having a compartment to be refrigerated in the upper portion thereof. The food compartment is separated by an insulated partition to include a machinery compartment in the lower portions of and adjacent the rear wall of the cabinet. The machinery compartment extends substantially between the side walls of the cabinet and has an access opening in the rear wall of the cabinet. A unitary refrigerating apparatus is adapted to be arranged in the machinery compartment through the access opening. The unitary apparatus includes a base member having a substantially horizontal support wall extending substantially between the side walls of the cabinet. Supported on the support wall is a hermetic compressor and an auxiliary condenser. The auxiliary condenser includes a serpentine tube portion disposed outside of the hermetic compressor which is connected to the compressor through the compressor outlet tube. A condensate collection container is disposed in heat exchange relation with the serpentine tube portion to form a condensate removal assembly.

Means are provided for supporting the container and the serpentine tube portion on the support wall. The support means includes a bracket having leg portions mounted on the support wall and a platform portion spaced from the support wall dimensioned to receive the condensate removal assembly. Locking means are provided to securely hold the condensate removal assembly relative to the platform. Both the compressor and condensate removal assembly are resiliently mounted on the support wall. To this end the elastomer support means are disposed between the compressor and the support wall, and between the leg portions and the support wall for resiliently supporting the compressor and condensate removal assembly relative to the support wall so that the compressor and condensate removal assembly vibrate in unison.

DESCRIPTION OF THE PREFERRED EMBODIMENT

Figure 1:
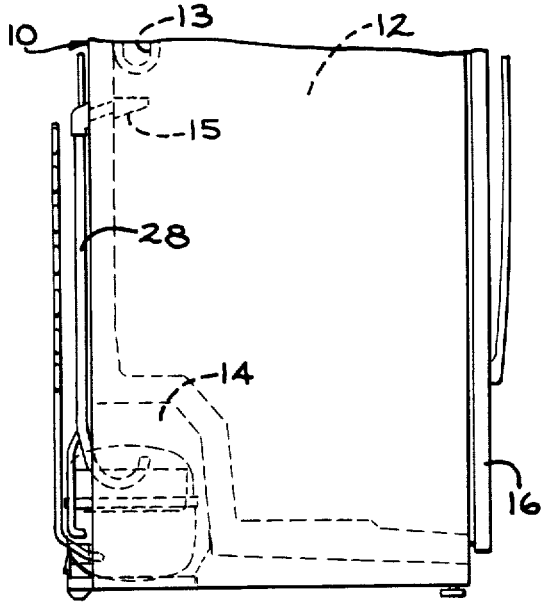
FIG. 1 is a fragmentary side elevational view of a refrigerator incorporating the preferred embodiment of the present invention.

In FIG. 1 is a partially illustrated a refrigerator cabinet 10 including a food storage compartment shown in outline and indicated by 12, and a machinery compartment 14 disposed below the food storage compartment. A door 16 hingedly mounted on the refrigerator cabinet 10 is provided for closing an access opening to the food storage compartment 12. Located in the compartment 12 is the refrigeration system evaporator 13 provided for cooling compartment 12.

Figure 3:
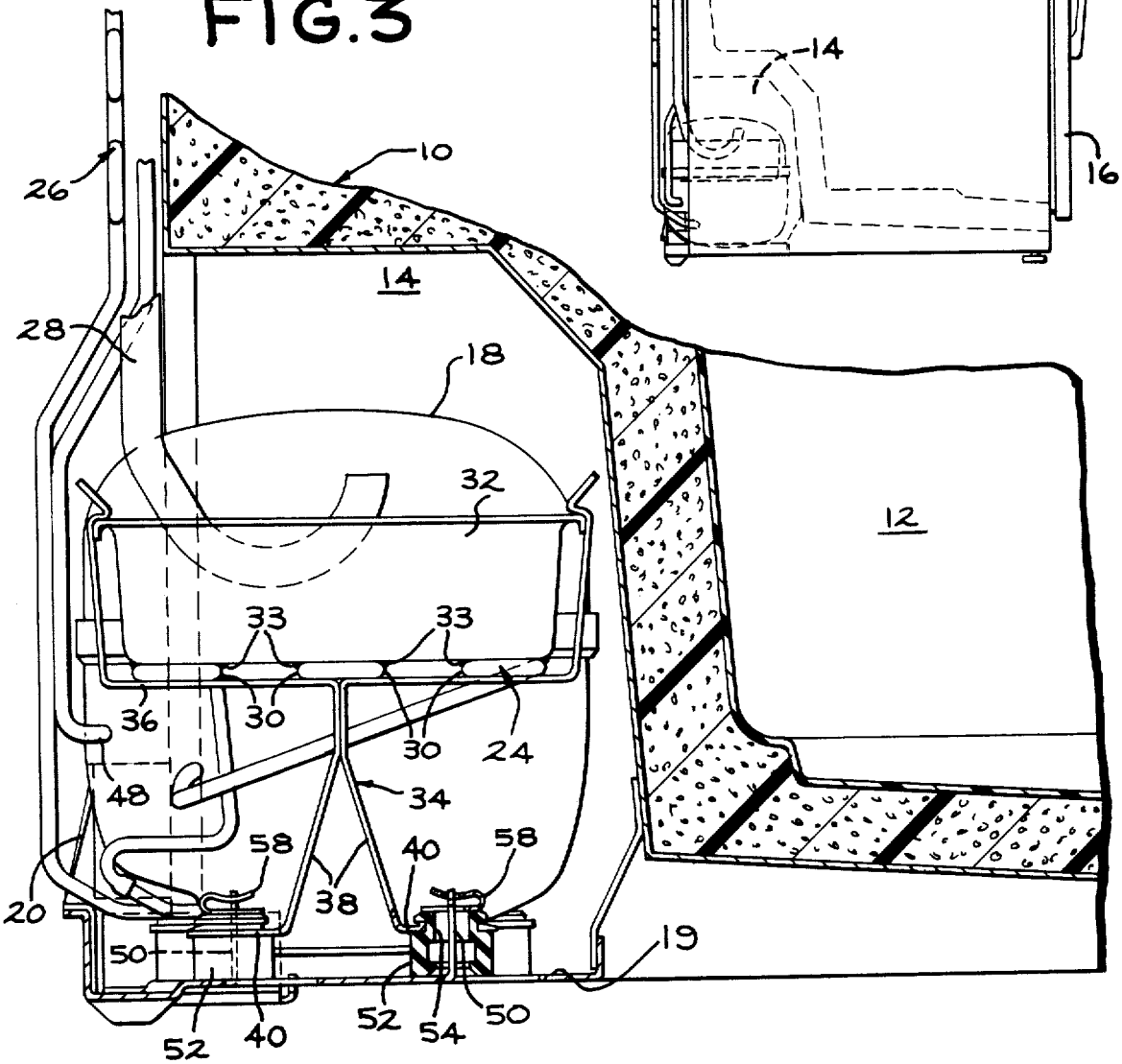
FIG. 3 is a section view taken above line 3—3 of FIG. 2.
Figure 2:
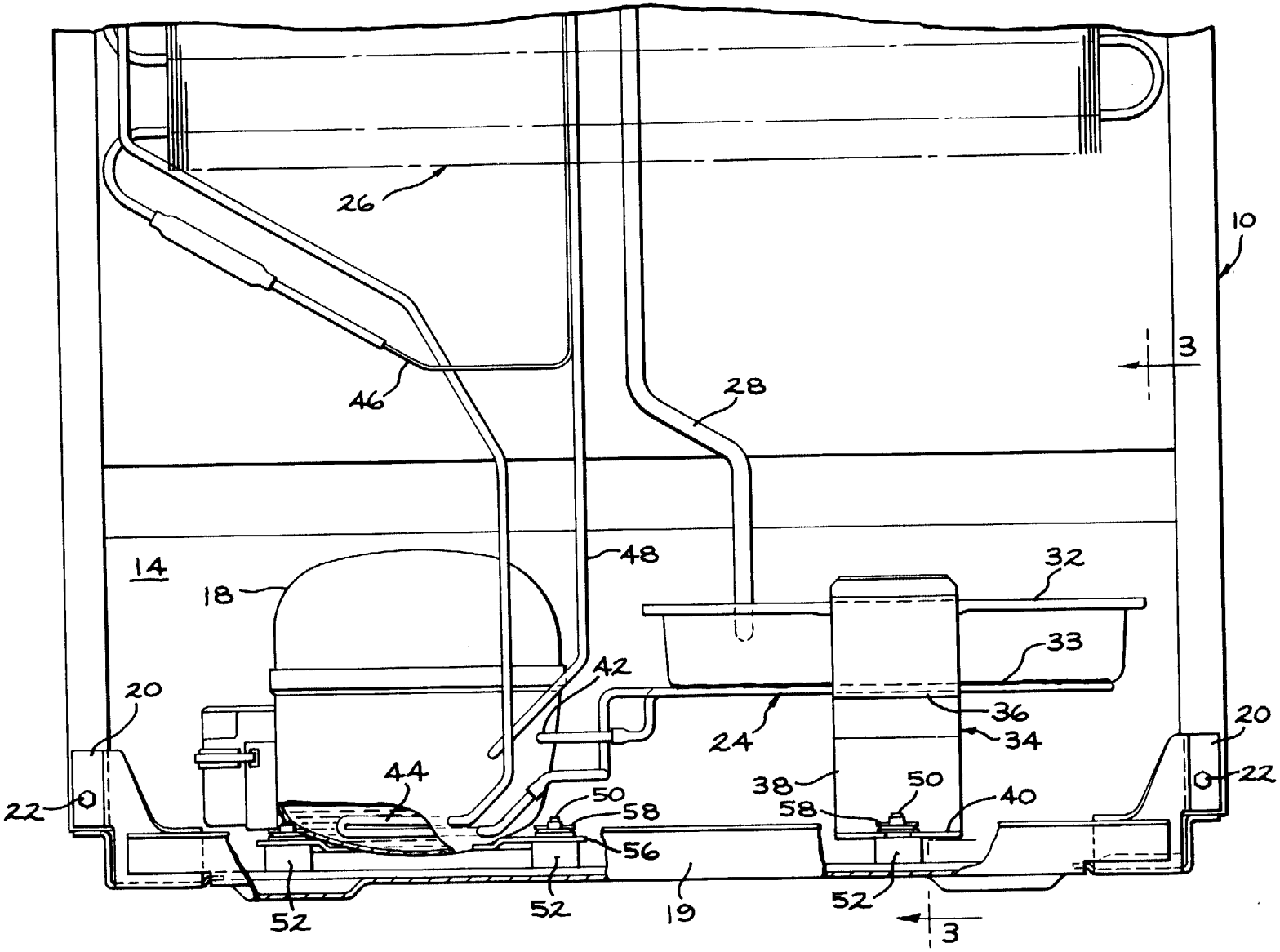
FIG. 2 is an enlarged rear elevational view showing the arrangement of components incorporating the preferred embodiment of the invention.

Referring now to FIGS. 2 and 3 there is shown located in the machinery compartment 14 is a refrigerating unit or compressor 18 mounted on a base member 19 which is adapted to be arranged in machinery compartment 14 through a rear access opening. The base member 19 extends substantially between the cabinet side walls and is secured to the cabinet 10 in any suitable manner such as by bracket 20 to front wall of compartment 14 and by bolts 22 to the rear wall of the cabinet. The compressor 18 is included in the refrigeration system provided for cooling the fresh food compartment. Also included in the refrigeration system and located in the machinery compartment 14 is an auxiliary condenser 24 which in operation assists the main condenser 26 in the system in dissipating heat absorbed by the system from the food storage compartment.

Figure 4:
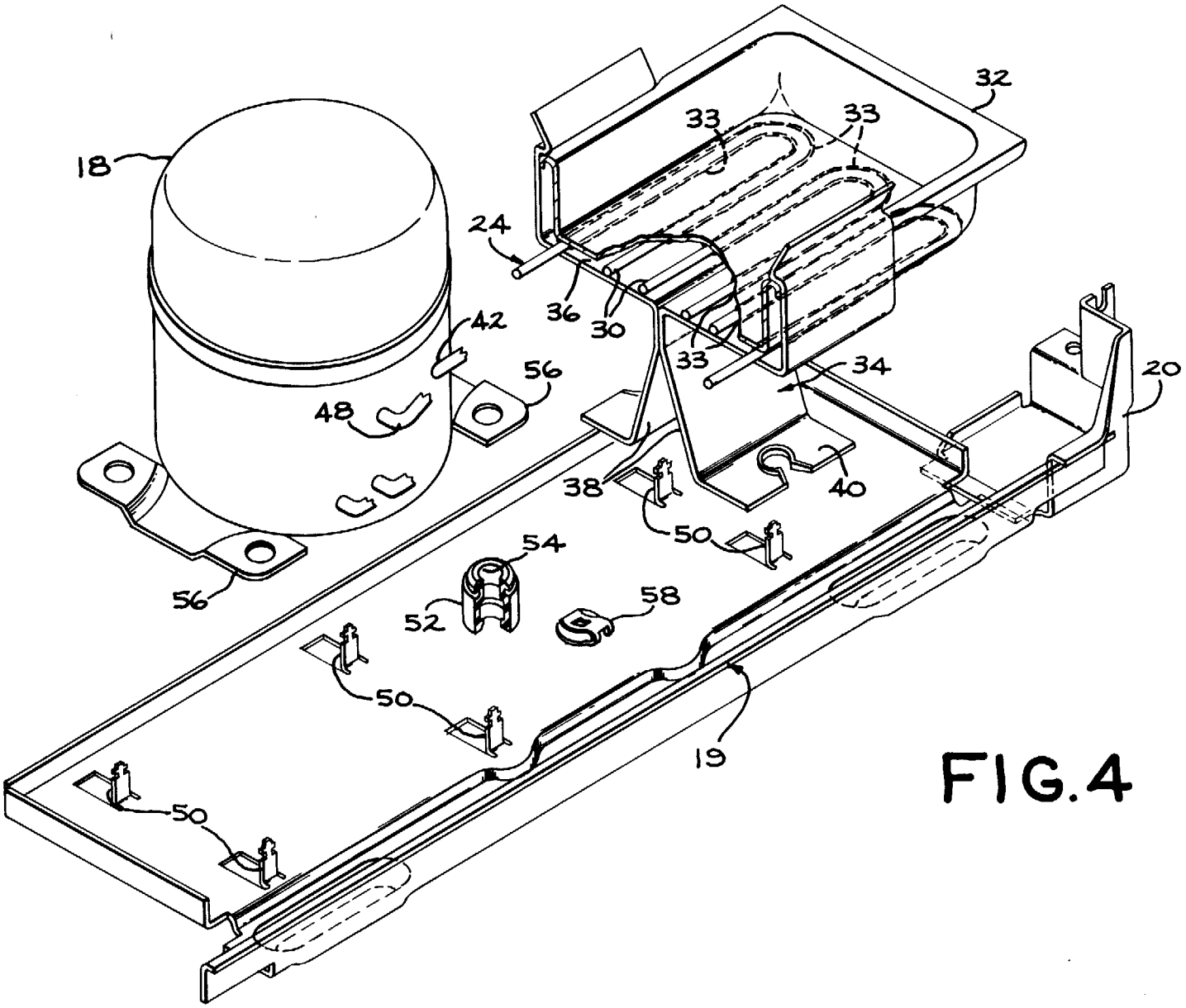
FIG. 4 is an exploded perspective view of the components incorporating the preferred embodiment of the present invention.

During normal operation of the refrigeration system the absorption of heat from the food storage compartment 12 results in the formation of frost on the evaporator 13 located in compartment 12. The defrost system employed in the present embodiment is generally referred to in the art as a cycle defrost system. In a cycle defrost system the fresh food compartment 12 in which the evaporator 13 is located is maintained at a temperature generally above freezing. Each time the compressor 18 is de-energized or cycles off during normal operation of the refrigerator any frost which may accumulate on the evaporator 13 during the period of time the compressor 18 is operating will in effect melt off by natural convection of the warmer air within the fresh food compartment 12. This defrost water or moisture resulting from the defrosting of the evaporator when the compressor is de-energized is collected by a trough 15 and is conducted by a tube 28 to the machinery compartment 14. As seen in FIGS. 2-4 the above-mentioned auxiliary condenser 24 may comprise a single conduit arranged in serpentine form and including a plurality of passes 30 disposed in a common horizontal plane. Secured to the upper sides of the passes 30 as by high temperature hot melt adhesive 33 is a moisture collecting pan 32.

In the present embodiment the pan 32 is fabricated from aluminum while the auxiliary condenser 24 may be of clad steel tubing. The use of a hot melt adhesive 33 along the entire length of the passes 30 provides both an effective bond between the dissimilar materials and an excellent heat exchange relationship therebetween. The effective heat exchange afforded between the condenser 24 and pan 32 by the use of a hot melt adhesive allows a minimum amount of tubing to be used which results in a machinery compartment which also utilizes a minimum amount of space in the refrigerator cabinet. It should also be noted that the adhesive used besides being self-curing should withstand temperature approaching 300° F. In the present embodiment the pan 32 is secured by adhesive in intimate heat exchange relationship with the auxiliary condenser 24 and accordingly the condensate collected in pan 32 is heated by relatively hot gaseous refrigerant flowing through the passes 30 of the auxiliary condenser 24. The auxiliary condenser 24 and pan 32 assembly which in effect forms a condensate removal assembly is mounted on the base member 19 and arranged spaced laterally therefrom to assure free circulation of air around the assembly. The auxiliary condenser and pan assembly includes a support member 34 which is formed to include a horizontal platform portion 36 on which the serpentine portion 30 of the auxiliary condenser 24 is arranged. Extending downwardly from this horizontal platfrom portion 36 are a pair of legs 38. The legs 38 include two outwardly and horizontally extending support portions 40 which are adapted to be supported on the base 19 in a manner to be explained hereinafter.

Because the present refrigerator employs a cycle defrost system wherein defrosting of the evaporator takes place each time the compressor is de-energized or cycles off during the normal operating mode of the refrigerator, the pan 32 receives water intermittently and at rather low volumes. This insures that the moisture collected in the pan 32 during each off cycle of the compressor is completely evaporated by the relatively hot gaseous refrigerant circulating through the serpentine portions 30 of the auxiliary condenser 24 during each on cycle of the compressor.

In the present embodiment of the invention the auxiliary condenser 24 is also employed as a compressor oil cooler. To this end as shown in FIG. 2 the auxiliary condenser 24 is connected at its inlet end to the compressor discharge 42 with its outlet end connected to a coil tube 44 arranged in the oil sump portion of the compressor 18. The outlet of coil 44 is connected to the main condenser 26 which is in turn series connected through a capillary 46 to the evaporator 13 and thence through a suction line 48 to the inlet of the compressor 18 to complete the refrigerant system. Generally the temperature of the gaseous refrigerant from the compressor discharge entering the auxiliary condenser 24 is in the range of 190°-200° F., however, in extreme ambient conditions the temperature may approach 300° F. This relatively hot temperature due to the heat exchange relationship afforded by the adhesive bond is effective in evaporating the water collected in the pan 32.

In operation, as the refrigerant passes through the auxiliary condenser 24 and enters the coil tube 44 in the oil sump of the compressor the temperature of the circulating refrigerent has fallen to approximately 140° F. Since the oil in the operating compressor oil sump is approximately 225° F. the temperature of the relatively cooler coil tube 44 is sufficient to cool the oil and accordingly an oil cooling arrangement is provided. Operation of the system is not affected since refrigerant which may condense in the coil 24 due to the cooling effect will boil and vaporize and accordingly reach the system condenser 26 as a vapor to be condensed.

As described the tubing connecting the compressor 18 to be auxiliary condenser 24 is rather rigid and accordingly vibrations generated by the operating compressor are transferred to the auxiliary condenser pan assembly. By the present invention means are provided for supporting the compressor 18 and auxiliary condenser 24 and pan 32 assembly so that they will vibrate in unison. To this end the compressor 18 and auxiliary condenser 24 and pan 32 assembly are resiliently mounted on the base member 19. As best shown in FIG. 4 the base member 19 is lanced in a plurality of spaced locations to provide a plurality of tabs 50. The tabs 50 to be used in mounting the compressor 18 and auxiliary condenser 24 and pan 32 are bent upwardly from the base as shown in FIG. 4 to provide vertically positioned support members. In the present instance as viewed in FIG. 4 one set of four tabs on the left hand side of the base member are provided to support the compressor 18 as will be explained, and another set of two tabs on the right hand side of the base member are provided to support the condenser pan assembly.

A resilient elastomer pad or member 52 which is formed to include a central passageway 54 is provided for each of the vertically extending support tabs 50. The resilient pads 52 as shown in FIG. 3 are arranged over the vertical extending support members 50. The vertical dimension of each of the vertical members 50 is greater than that of the pads 52 and accordingly the upper ends extend through the passageways 54. The compressor 18 includes leg portions 56 which correspond in number and location to the one set of support members 50 formed in base member 19. The legs 40 of member 34 align with the other set of support members 50 formed in base 19. With the auxiliary condenser and compressor mounted or positioned as shown in FIGS. 2 and 3 a clip 58 is attached to the upper free end of the vertical support member. The spring clip 58 engages retaining slots 60 formed in the free upper end of the support members 50 so as to trap the resilient pad 52 between the clip 58 and the base member 19. As can be seen by the present support system both the compressor and the support structure for the auxiliary condenser pan assembly are resiliently supported on the base member 19.

It should be understood that depending on the compressor employed it may not be necessary to provide oil cooling as described above in which instance the coil portion 44 may be eliminated. In this instance the outlet of the auxiliary condenser 24 would be connected directly to the inlet of the main condenser 26. In another instance, for example in employing rotary compressors, the auxiliary condenser may be employed as a desuper heater coil feeding partially condensed refrigerant to the compressor for cooling purposes.

In summary, by the present invention there has been provided a compressor and auxiliary condenser mounting arrangement for evaporating defrost moisture and if desired for cooling the compressor oil including a mounting system which allows the arrangement to vibrate in unison under influence of the operating compressor.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A household refrigerator including a cabinet having a compartment to be refrigerated in the upper portion thereof separated by an insulated partition to include a machinery compartment in the lower portions of and adjacent the rear wall of said cabinet, said compartment extending substantially between the side walls of the cabinet and having an access opening in the rear wall of said cabinet, a unitary refrigerating apparatus adapted to be arranged in said machinery compartment through said access opening, comprising:

a base member having a substantially horizontal support wall extending substantially between said side walls;

a hermetic compressor mounted on said support wall;

a condensate disposing means and oil cooling arrangement including an auxiliary condenser having a first portion located inside said compressor and a second serpentine tube portion disposed outside said hermetic compressor connected to said compressor and a condensate collection container disposed above said serpentine tube portion;

means securing said container in heat exchange relation with said serpentine tube portion whereby the high thermal conductivity and condensate evaporation rates are insured;

means supporting said condensate disposing means on said support wall including a bracket having leg portions mounted on said support wall and a platform portion spaced from said support wall being dimensioned to receive said container;

locking means being dimensioned to engage said container to securely hold said condensate disposing means relative to said platform;

an elastomer support means disposed between said compressor and said support wall, and between said leg portions and said support wall for resiliently supporting said compressor and said condensate disposing means relative to said support wall so that said compressor and oil cooling arrangement vibrate in unison.

2. A household refrigerator recited in claim 1 wherein said compressor includes a casing, a sump disposed in the lower portion of said casing for holding cooling medium, said auxiliary condenser further includes a tube portion arranged in said compressor sump in heat exchanging relationship with said cooling medium.

3. The invention recited in claim 1 wherein said base member further includes a plurality of holding tab members formed being dimensioned so as to be bendable selectively to project upwardly from said base member to an operative position;

a first set of resilient members including a passageway for receiving a first set of selected upwardly positioned holding tab members with the upper free end of said holding tab members extending above said resilient members;

upper body portion on said compressor including openings therein for receiving the upper free end of said holding tab members;

holding means secured to said upper free end of said holding tab member for resiliently securing said compressor to said resilient member;

a second set of resilient members including a passageway for receiving a second set of selected upwardly positioned holding tab members;

holding means secured to said upper free end of said holding tab member for resiliently securing said compressor to said resilient member.

4. A household refrigerator recited in claim 3 wherein said condensate collection container is fabricated of aluminum and said securing means is a hot melt self-curing adhesive.

* * * * *